US005246311A

United States Patent [19]

West et al.

[11] Patent Number: 5,246,311

[45] Date of Patent: Sep. 21, 1993

[54] FOUNDATION REPAIRING SYSTEM

[75] Inventors: Johnny L. West, Kansas City; Jeffery L. West, Grandview, both of Mo.

[73] Assignee: Anchor Foundation, Inc., Kansas City, Mo.

[21] Appl. No.: 930,380

[22] Filed: Aug. 14, 1992

[51] Int. Cl.[5] ..... E02D 5/00

[52] U.S. Cl. ..... 405/230; 405/229

[58] Field of Search ..... 405/230, 229, 303, 290, 405/232, 231; 254/29 R

[56] References Cited

U.S. PATENT DOCUMENTS

| | | | |
|---|---|---|---|
| 3,902,326 | 9/1975 | Langenbach | 405/230 X |
| 4,634,319 | 1/1987 | May | 405/230 |
| 4,673,315 | 6/1987 | Shaw et al. | 405/230 |
| 4,678,373 | 7/1987 | Langenbach, Jr. | 405/230 |
| 4,695,203 | 9/1987 | Gregory | 405/230 |
| 4,708,528 | 11/1987 | Rippe | 405/230 |
| 4,765,777 | 8/1988 | Gregory | 405/230 |
| 4,854,782 | 8/1989 | May | 405/230 |
| 4,925,345 | 5/1990 | McCown, Jr. et al. | 405/230 |
| 5,011,336 | 4/1991 | Hamilton et al. | 405/230 |
| 5,013,190 | 5/1991 | Green | 405/230 |
| 5,120,163 | 6/1992 | Holdeman et al. | 405/230 |

*Primary Examiner*—Dennis L. Taylor

*Attorney, Agent, or Firm*—Litman, McMahon & Brown

[57] ABSTRACT

An improved foundation repairing system includes a plurality of pierheads secured to exposed portions of a foundation. Each of the pierheads has an angular ledge abutting an outer surface and a bottom surface of the foundation. A pier is driven, section by section, vertically downwardly through a pier guide of a respective one of the pierheads by a pier driver in conjunction with a pier driving bracket in order to obtain the necessary support from the underlying ground. The pier driver has a pair of opposing first upright members straddling the pier guide, which are temporarily attached to the foundation and a pair of opposing first foot members operably extending beneath the foundation. A plurality of secondary lifting mechanisms, in cooperation with piers previously installed by the pier driver, are adapted to cooperatively elevate the foundation. The pier guides of the pierheads are fixedly connected to the respective piers to provide permanent support for the foundation. A hardenable slurry provides further permanent support for the pierheads. A method for establishing permanent support for a building structure foundation is also provided.

5 Claims, 2 Drawing Sheets

FOUNDATION REPAIRING SYSTEM

BACKGROUND OF THE INVENTION

1. Field of the Invention.

The present invention relates generally to a system for lifting and supporting a building structure and, more particularly, without limitation, for stabilizing and correcting settlement of a building structure, in whole or in part.

2. Description of the Related Art.

Settling of building structures is a common phenomena, the effects of which can be extremely devastating to the integrity of the structure. Not only do the supporting foundations separate and move but the aboveground portions of the structure also separate causing unsightly cracks and other underdesirable traits.

The settling can arise from a variety of causes, such as failure to properly engineer the underlying ground before erecting the building structure, placing the structure partially or entirely on backfilled soil, and the like. If the ground is not properly prepared, then the ability of the ground to provide the necessary bearing capacity to support the erected structure varies widely under the building structure. As a result, portions of the building experience better support that other portions, causing differential settling of certain parts of the structure relative to other parts of that same structure.

Many different types of solutions have been developed in an attempt to stabilize the foundations of such building structures, some of those solutions being more practical or cost-effective than others. For example, one method has involved drilling pier holes near strategic sites around the edges of the building structure whereby piers of concrete, extending from the foundation to bedrock, are used to support the building and prevent further settling thereof. Obviously, this approach may require substantial excavation and significant investment in labor and material. For larger building structures, such an approach may be the only remedy presently available.

For other, smaller structures, however, various methods of providing stabilizing support have been developed, some of them more successful than others. What is needed is a system which is portable and which requires minimal excavation and minimal expenditures of labor and material.

SUMMARY OF THE INVENTION

An improved foundation repairing system includes a plurality of pierheads secured to exposed portions of a foundation. Each of the pierheads has a pier guide and an angular ledge with a horizontal portion adaped to abut an outer surface of the foundation as a vertical portion of the angular ledge abuts a bottom surface of the foundation.

A plurality of piers, each comprising a plurality of pier sections having ends configured to form a male-female connection as the pier sections are positioned in end-to-end relationship. The foundation repairing system includes a pier driving bracket and a pier driver, which are adapted to cooperatively drive the piers, pier section by pier section, vertically downwardly through the pier guide of a respective one of the pierheads, and to continue so driving each of the piers until necessary resistance is encountered from the underlying ground which is sufficient to support the foundation, in cooperation other other similarly situated piers, if necessary, in a repaired condition.

The pier driving bracket has a pair of opposing first upright members, which are adapted to straddle the pier guide and to be temporarily attached to the foundation as one of the piers is being driven, and a pair of opposing first foot members, which are adapted to extend beneath the foundation. The pier driver comprises a hydraulic piston-and-cylinder having a ram which operably thrusts vertically downwardly.

A plurality of secondary lifting mechanisms, in cooperation with piers previously installed by the pier driver and generally in cooperation with the pier driver, are adapted to uniformly elevate the foundation in unison.

Each of the secondary lifting mechanisms has a pair of opposing second upright members, which are adapted to straddle the pier guide and to operably abut the vertical portion of one of the pierheads, and a pair of opposing second foot members, which are adapted to extend beneath the foundation and to operably abut the corresponding horizontal portion of the pierhead, as the foundation is being elevated to a repaired condition.

The pier guides of the pierheads are adapted to be fixedly connected to the respective piers extending therethrough to provide permanent support for the foundation. A hardenable slurry provides further permanent support for the pierheads.

The foundation repairing system includes a method for providing permanent support for repairing a foundation of a building structure.

PRINCIPAL OBJECTS AND ADVANTAGES OF THE INVENTION

The principal objects and advantages of the present invention include: providing a foundation repairing system for elevating and supporting a settled foundation of a structure; providing such a foundation repairing system which can be used to stabilize a foundation; providing such a foundation repairing system which requires minimal excavation and site preparation; providing such a foundation repairing system which is relatively concealable after installation thereof; providing such a foundation repairing system whereby a plurality of stations along a foundation can be elevated in unison; providing such a foundation repairing system which is fixedly secured to the foundation being repaired; providing such a foundation repairing system which is relatively simple to operate; providing such a foundation repairing system which is portable; providing such a foundation repairing system which requires minimal labor and expense; providing such a foundation repairing system which requires only minimal modification to the foundation; providing such a foundation repairing system which can be performed without interior excavation; and providing such a foundation repairing system which is efficient, economical to manufacture and operate, reliable, easy to use and which generally performs the requirement of its intended purposes.

Other principal objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
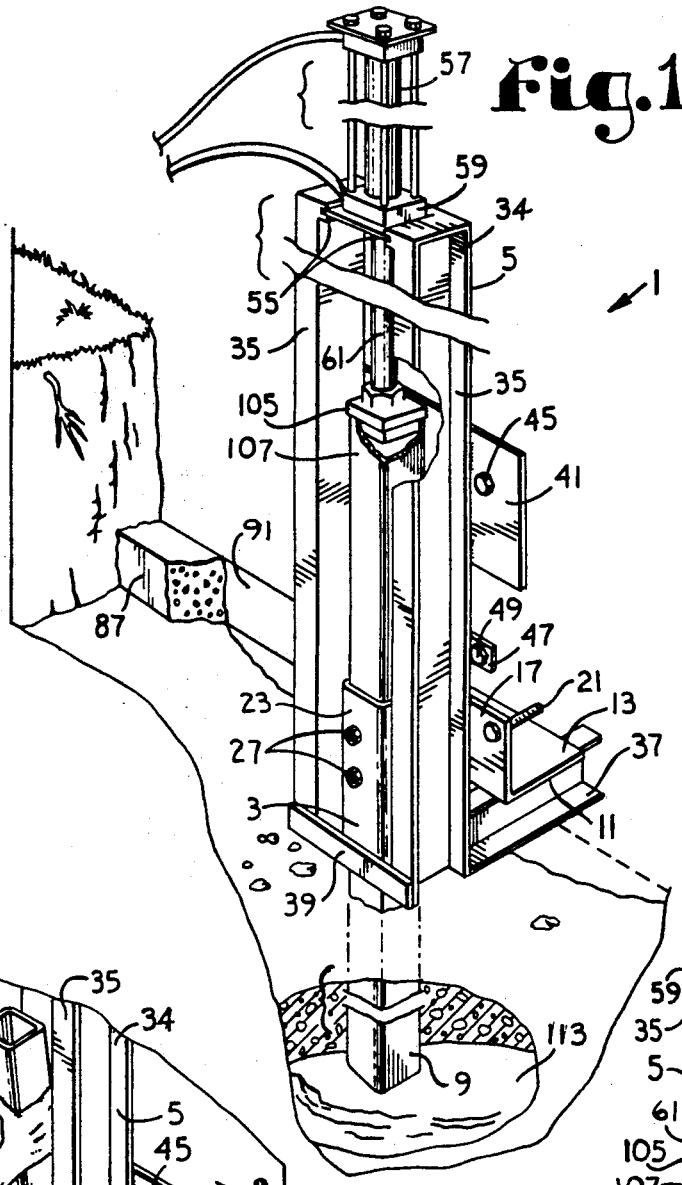
FIG. 1 is a perspective, fragmentary view of a foundation repairing system, showing one end of a pier thereof bearing against bedrock and showing a foundation partially in phantom for purposes of clarity, according to the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

The reference numeral 1 generally refers to a foundation repairing system in accordance with the present invention, as shown in FIG. 1 through 8. The system 1 generally includes a plurality of pierheads 3, pier driving means such as a primary listing mechanism 5, a plurality of secondary listing mechanisms 7, and a plurality of piers 9.

Figure 7:
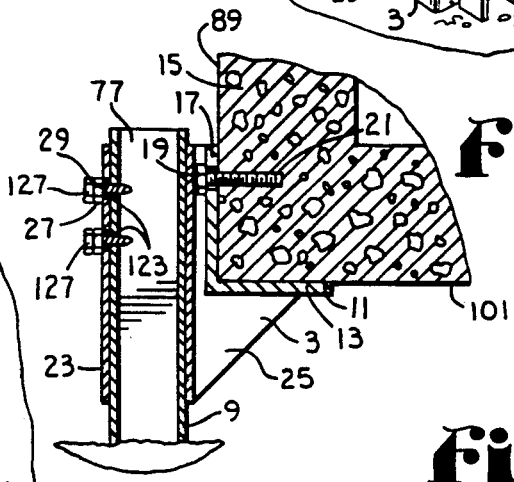
FIG. 7 is a fragmentary, cross-sectional view of the foundation repairing system, on a larger scale than FIG. 1, showing the pierhead secured to the pier and to the foundation.

Each of the pierheads 3 includes an angularly shaped ledge 11 having a horizonal portion 13, which is adapted to be spaced beneath a foundation 15, and a vertical portion 17, which is adapted to be spaced alongside the foundation 15, as shown FIG. 7. The vertical portion 17 generally includes throughbores 19 for securing the pierhead 3 to the foundation 15 with bolts 21, or other suitable fasteners.

Figure 4:
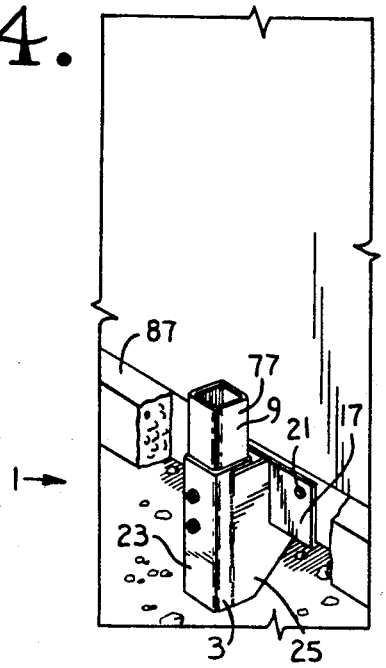
FIG. 4 is a perspective view of a pierhead of the foundation repairing system, on a smaller scale than FIG. 1, showing the pier positioned within the pier guide.

Each of the pierheads 3 also includes aligning means such as a pier guide 23, which is generally vertically originated as the respective pierhead 3 is secured to the foundation 15, as hereinafter described. The ledge 11 and the pier guide 23 of each of the pierheads 3 are generally fixedly secured together by a pair of sidewalls 25, as shown in FIGS. 4 and 7. Each of the pierheads 3 also includes one or more reinforcing bosses 27, each surrounding a throughbore 29 in the respective pier guide 23.

The pier guide 3 generally has a square shaped cross-sectional profile. It is foreseen, however, that the cross-sectional profile of the pier guide 23 could have a variety of other geometrical profiles, such as circular, triangular, and the like.

Figure 3:
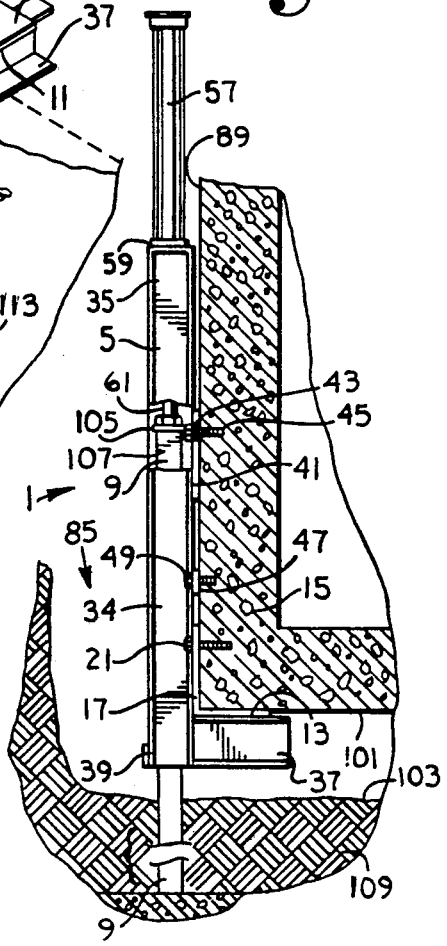
FIG. 3 is a side-elevational view of the foundation repairing system, on a smaller scale than FIG. 1, taken generally along line 3—3 of FIG. 2, showing portions cut away to reveal details thereof and showing a foundation being supported thereby.

The pier driving means 5 generally includes a pier driving bracket 34 having an opposing pair of upright members 35, which are adapted to be spaced generally vertically along opposite sides of the pier guide 23. The pier driving bracket 34 also includes a foot member 37 fixedly secured to, and extending perpendicularly from, each of the upright members 35 near a lower extremity thereof, as shown in FIG. 3. The upright members 35 and the foot members 37 are generally constructed of channel steel or other suitable, structural-type material.

The upright members 35 are generally fixedly spaced from each other in parallel fashion by an outer brace member 39 secured to the upright members 35 near lower extremities thereof and opposite the foot member 37, and by a wall brace member 41, as shown in FIG. 1. The wall brace member 41 generally includes throughbores 43 which are adapted to secure the pier driving bracket 34 to the foundation 15 by bolts 45, or other suitable fasteners.

The pier driving bracket 34 may also include a stabilizing brace member 47, which is fixedly secured to the upright members 35, and is adapted to be securable to the foundation 15 by bolts 49, or other suitable fasteners. The pier driving bracket 34 also includes mounting means, such as a pair of opposing slots 55 formed in the upright members 35 near upper extremities thereof, as shown in FIG. 1.

The pier driving means 5 also includes a pier driver 57, such as a remotely controlled hydraulic piston-and-cylinder arrangement. The pier driver 57 includes a mounting plate 59 which is adapted to cooperate with the slots 55 such that a ram 61 of the pier driver 57 is thrust generally vertically downwardly, as shown in FIG. 1.

Each of the secondary lifting mechanisms 7 generally includes a pair of upright members 67, each having a foot member 69 fixedly secured perpendicularly to a lower extremity thereof. The upright members 67 are generally parallel and are spaced apart by a crossbeam 71, such that the upright members 67 can straddle the pier guide 23. The upright members 67 and the foot members 69 are generally constructed of channel steel, or other suitable structural-type material. The crossbeam 71 is generally constructed from I-beam stock, or other suitable structural-type material.

Figure 2:
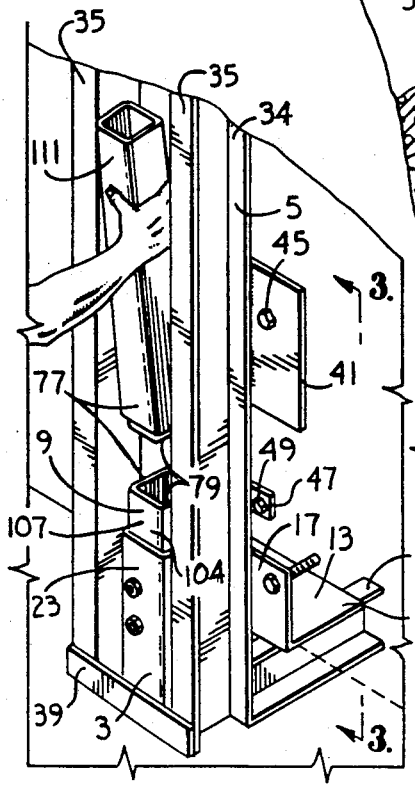
FIG. 2 is a fragmentary, perspective view of the foundation repairing system, similar to FIG. 1 but showing a section of the pier being placed onto another section of the pier, which has been inserted through a pier guide.

Each of the piers 9 is generally constructed of a plurality of pier members or pier sections 77. Ends 79 of the pier sections 77, are configured such that adjacent pairs of the pier sections 77, when engaged in an end-to-end abutting arrangement, are joined by a male/female connection, as indicated in FIG. 2. The pier sections 77 have a cross-sectional profile which is similar to, but slightly smaller than, the cross-sectional profile of the pier guides 23 such that the pier sections 77 can be slidably displaced through the pier guides 23.

In an application of the foundation repairing system 1, access to a portion of the foundation 15 to be repaired is provided by excavating adjacently alongside, and beneath of, the foundation 15, as indicated by the numeral 85 in FIG. 3. If the foundation 15 includes a grade beam or footing 87 that extends outwardly from the foundation 15, outwardly extending portions of the footing 87 are broken away to form an outer footing profile which aligns generally vertically with an outer surface 89 of the foundation 15, as indicated by the numeral 91 in FIG. 1.

After constructing the excavation 85, one of the pierheads 3 is positioned such that the horizontal portion 13 thereof is spaced in abutting engagement with a lower surface 101 of the foundation 15 as the vertical portion 17 is spaced in abutting engagement with the outer surface 89, as shown in FIG. 3. The pierhead 3 is than secured to the foundation 15 by the bolts 21.

Next, the pier driving bracket 34 is positioned such that the upright members 35 straddle the pier guide 23, with the foot members 37 spaced in abutting engagement with the horizonal portion 13 and the wall brace member 41 spaced in abutting engagement with the outer surface 89. The pier driving bracket 34 is then secured to the foundation 15 by the bolts 45. If desired, the stabilizing brace member 47 may also be secured to the foundation 15 by the bolts 49.

One of the pier sections 77 is then manually inserted vertically downwardly through the pier guide 23 until it rests against ground surface 103, which was exposed by the excavation 85.

The mounting plate 59 of the piston-and-cylinder 57 is then mounted in the slots 55, as shown in FIG. 1, and the pier driver 57 is activated such that the ram 61 is thrust vertically downwardly to contact the pier member 77 contained in the pier guide 23, such as the pier member 77 designated by the numeral 104 in FIG. 2. Preferably, the ram 61 is fitted with an adapter 105, which is configured to mate with a distal end 107 of the pier member 77, as shown in FIG. 1. The ram 61 is then further activated to drive the pier member 77 downwardly into underlying ground 109 until the distal end 107 approaches the pier guide 23, as shown in FIG. 2.

The ram 61 is then retracted and another one of the pier sections 77, such as the pier member 77 designated by the numeral 111 in FIG. 2, is inserted between the pier member 104 and the ram adaptor 105 such that the pier member 111 is joined to the pier member 104 by a male/female connection. The pier driver 57 is then reactivated, driving both the pier member 104 and the pier member 111 vertically downwardly as previously described. This procedure is repeated until the lowermost one of the pier sections 77 so driven downwardly by the pier driver 57 hits bedrock 113, or encounters other resistance which is sufficient to support the foundation 15 in a repaired conditioned.

The pier driver 57 is then retracted and removed from the pier driving bracket 34. Also, the bolts 45 and 49 are removed and the pier driving bracket 34 is also removed, leaving only the pierhead 3 secured to the foundation 15 with the uppermost one of the installed pier sections 77 extending upwardly through the respective pier guide 23.

The excavation 85, the installation of one of the pierheads 3, and the installation of vertically aligned pier sections 77, as hereinbefore described, is repeated at each location along the foundation 15 where it is desired to install support for the foundation 15. For each such location, except for the last such location, the pier driving means 5 is removed after installation of the respective pier 9 is complete. The pier driving means 5, however, is not generally removed from the last such location until after the foundation 15 is leveled or otherwise supported as hereinafter described.

Figure 5:
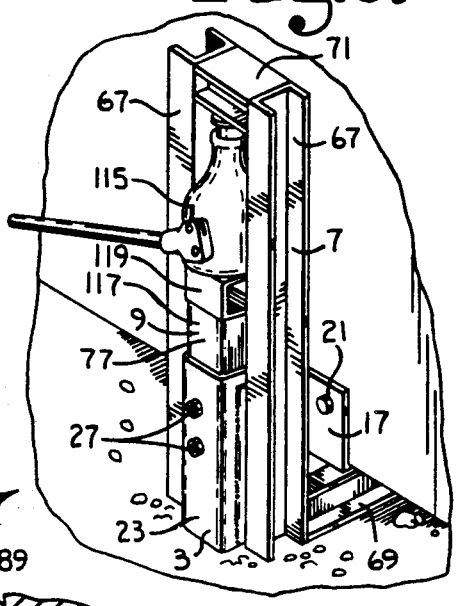
FIG. 5 is a perspective view of the foundation repairing system, similar to that of FIG. 4, but showing a bottle jack and a spacer positioned between a lifting bracket and the pier positioned with the pier guide.

For each of the leveling/supporting locations along the foundation 15, except for the last such location, one of the secondary lifting mechanisms 7 is installed as follows. Each of the secondary lifting mechanisms 7 is positioned such that the upright members 67 straddle one of the pier guides 23 and such that the foot members 69 are spaced in abutting engagement with the respective horizonal portion 13 of the ledge 11 as the upright members 67 are spaced in abutting engagement with the respective vertical portion 17 of the ledge 11. A bottle or house jack 115 is then spaced between an upper end 117 of the pier 9 and the crossbeam 71, as shown in FIG. 5. If necessary, one or more spacers 119 are positioned between the jack 115 and the pier upper end 117 in order to extend the reach of the jack 115 as it is activated.

Figure 6:
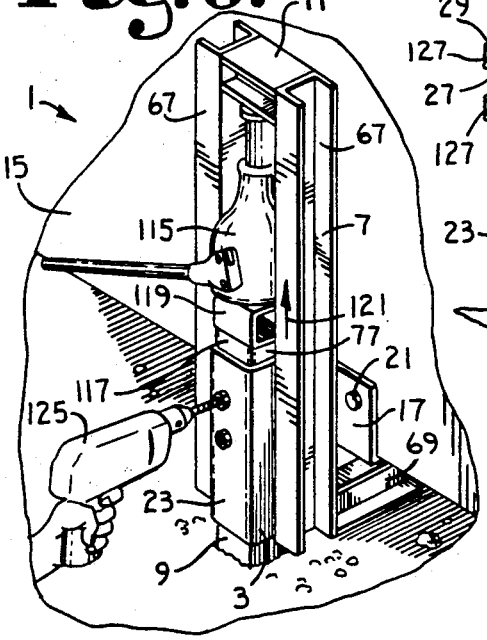
FIG. 6 is a perspective view of the foundation repairing system similar to that of FIG. 5, showing the pier guide being secured to the pier.

The jack 115 is then used to force the pierhead 3 upwardly relative to the pier 9, as indicated by the arrow designated by the numeral 121 in FIG. 6, until the foundation 15 has been raised to the desired elevation. Each of the similarly installed secondary lifting mechanisms 7 and the pier driving means 5 situated at each of the other locations are all concurrently activated to cooperatively lift and support, in unison, the foundation 15 at the various locations.

A permanent support for the foundation 15 is provided by drilling one or more appropriately sized throughbores 123 in the uppermost pier member 77 such that the bores 123 align with respective ones of the bores 29, as indicated by the numeral 125 in FIG. 6, and installing the respective bolts 127 therein.

Figure 8:
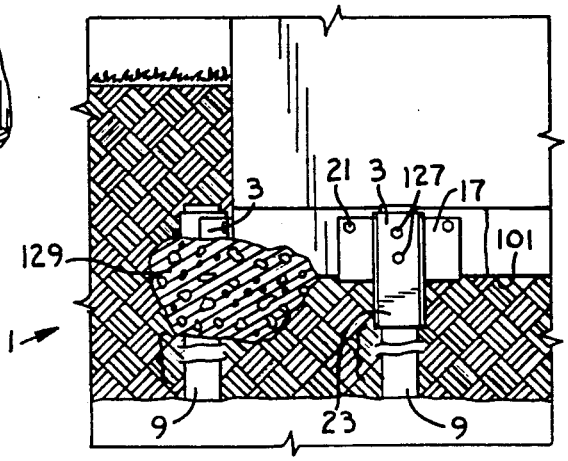
FIG. 8 is a fragmentary, side-elevational view of a pair of pierheads and piers of the foundation repairing system, on a smaller scale than FIG. 1, showing one of the pierheads embedded in a concrete slurry, according to the present invention.

After removing the bottle jacks 115, the secondary lifting mechanisms 7, and the pier driving means 5, each of the pierheads 3 and adjacent portions of the lower surface 101 of the foundation 15 may be embedded in a mud or concrete slurry 129 or other suitable material, as shown in FIG. 8, if desired, in order to provide additional permanent support.

It is to be understood that while certain forms of the present invention have been illustrated and described herein, it is not to be limited to the specific forms or arrangement of parts described and shown.

What is claimed and desired to be secured by Letters Patent is as follows:

1. A foundation repairing system for repairing a foundation having an outer surface and a bottom surface, said system comprising:

(a) a plurality of piers, each comprising at least one pier section; each said pier section having ends adapted to form a male-female connection between adjacent pairs of said pier sections spaced in an end-to-end abutting arrangement; said pier sections having a generally square-shaped outer profile;

(b) a plurality of pierheads, one for each of said piers; each said pierhead having a pier guide with an inner profile substantially similar to said outer profile of said pier sections such that said pier sections are slidable therethrough; each said pier guide adapted to vertically orient a respective one of said pier sections positioned therein; each of said pierheads having an angularly shaped ledge with a horizontal portion and a vertical portion; said vertical portion adapted to abut said outer surface of said foundation as said horizontal portion abuts said bottom surface of said foundation; said pierhead adapted to be secured to the foundation such that said pier guide thereof is aligned generally vertically as said horizontal portion thereof abuts said bottom surface of the foundation and said vertical portion thereof abuts said outer surface of the foundation;

(c) a pier driving bracket having an opposing pair of parallel spaced first upright members and an opposing pair of first foot members secured perpendicularly to lower extremities of said first upright members; said pier driving bracket including means for securing same to the foundation and means for engaging same with a respective said pierhead such that said first upright members thereof are aligned generally vertically and straddle respective said pier guide, and such that said first foot members thereof operably abut said horizontal portion of said pierhead;

(d) a pier driver adapted to be removably secured to upper extremities of said pier driving bracket such that one of said pier sections spaced therebelow is drivable generally vertically downwardly through a respective one of said pier guides into the underlying ground by said pier driver; said pier driver having an adapter adapted to mate with a distal end of said pier section spaced therebelow;

(e) a plurality of secondary lifting mechanisms; each of said secondary lifting mechanisms including a jack; each of said secondary lifting mechanisms having an opposing pair of parallel spaced second upright members and an opposing pair of second foot members secured perpendicularly to lower extremities of said second upright members such that said second upright members thereof are aligned generally vertically and straddle respective said pier guide; each said secondary lifting mechanism including means for securing same to the foundation and means for engaging same with a respective said pierhood such that said second foot members thereof operably abut said horizontal portion of said pierhead; and (f) a plurality of threaded fasteners adapted to secure each of said pier guides to a respective one of said piers.

2. A method for repairing a foundation, including the steps of:

(a) providing apparatus, which includes the following:

(1) a plurality of piers, each comprising at least one pier section;

(2) a pierhead for each of said piers; each said pierhead with an angularly shaped ledge, having a horizontal portion and a vertical portion, and a pier guide for vertically orienting a respective one of said piers;

(3) pier driving means for individually driving each of said piers; said pier driving means having an opposing pair of parallel spaced first upright members and an opposing pair of first foot members;

(4) a plurality of secondary lifting mechanisms for lifting the foundation in cooperation with said pier driving means, each having an opposing pier of parallel spaced second upright members and an opposing pier of second foot members; and (5) securing means for securing each of said piers to a respective one of said pierheads;

(b) providing access to at least one portion of the foundation to be repaired wherein each said access includes exposure of an outer surface of the foundation and a bottom surface of the foundation spaced immediately adjacent to said outer surface;

(c) removing exposed portions of a footing which extend horizontally outwardly from said outer surface of the foundation;

(d) attaching said pierhead to the foundation such that said pier guide thereof is aligned generally vertically as said horizontal portion thereof abuts said bottom surface of the foundation and said vertical portion thereof abuts said outer surface of the foundation;

(e) securing said pier driving means to the foundation such that said first upright members thereof are aligned generally vertically and straddle respective said pier guide, and engaging said pier driving means with said pierhood such that said first foot members thereof operably abut said horizontal portion of said pierhead;

(f) placing one of said pier sections between said pier driving means and said pierhead such that said pier section is aligned with said pier guide;

(g) activating said pier driving means such that said pier section is driven generally vertically downwardly into the underlying ground;

(h) retracting said pier driving means and repeating steps (f) and (g) with additional ones of said pier sections until resistance is encountered from the underlying ground which is sufficient to support the foundation in a repaired condition;

(i) retracting and removing said pier driving means, and repeating steps (b) through (h) at each other access location, if any, along the foundation as desired, and leaving the pier driving means attached to the foundation at the last one of said access locations;

(j) with the exception of the last said location, placing one of said secondary lifting mechanisms at each of said access locations such that said second upright members thereof are aligned generally vertically and straddle respective said pier guide, engaging said secondary lifting mechanism with said pierhead such that said second foot members thereof operably abut said horizontal portion of said pierhead, and appropriately positioning one of said jacks in each of said secondary lifting mechanisms;

(k) concurrently operating said jacks in unison such that the foundation is elevated as desired by said secondary lifting mechanisms;

(l) fixedly securing each of said pier guides to respective said piers;

(m) removing said pier driving means and said secondary lifting mechanisms;

(n) providing concrete slurry about each of said pierheads if desired; and (o) backfilling about each of said access locations.

3. The system according to claim 1, including:

(a) concrete slurry adapted to at least partially embed said pierheads.

4. The system according to claim 1, wherein:

(a) said pier driver is a remotely operated hydraulic piston-and-cylinder arrangement.

5. The system according to claim 1, including:

(a) a spacer disposed between said jack and said pier.

* * * * *